US011500333B2

(12) United States Patent
Delizee et al.

(10) Patent No.: US 11,500,333 B2
(45) Date of Patent: Nov. 15, 2022

(54) TIMEPIECE COMPONENT WITH A NON-MAGNETIC SHAFT-LIKE PORTION MADE OF CERAMIC

(71) Applicant: Blancpain SA, Le Brassus (CH)

(72) Inventors: Alain Delizee, Les Bioux (CH); Cedric Reymond, Les Bioux (CH)

(73) Assignee: Blancpain SA, Le Brassas (CH)

( * ) Notice: Subject to any disclaimer, the term of this patent is extended or adjusted under 35 U.S.C. 154(b) by 726 days.

(21) Appl. No.: 16/436,987

(22) Filed: Jun. 11, 2019

(65) Prior Publication Data

US 2020/0019119 A1 Jan. 16, 2020

(30) Foreign Application Priority Data

Jul. 10, 2018 (EP) ..... 18182666

(51) Int. Cl.
*G04B 13/02* (2006.01)

(52) U.S. Cl.
CPC ..... *G04B 13/022* (2013.01); *G04B 13/026* (2013.01)

(58) Field of Classification Search
CPC .... G04B 13/02; G04B 13/022; G04B 13/026; G04B 43/00; G04B 15/14; G04B 1/16; G04B 17/34; G04D 3/0084; G04D 3/0254
See application file for complete search history.

(56) References Cited

U.S. PATENT DOCUMENTS 5,515,607 A * 5/1996 Ikegami ..... G04C 3/008 74/432
2002/0114225 A1* 8/2002 Damasko ..... G04B 15/14 368/125
2011/0273969 A1* 11/2011 Forsey ..... G04B 31/00 368/324
2017/0357213 A1 12/2017 Linck

FOREIGN PATENT DOCUMENTS

CN 202093328 U 12/2011
CN 103265287 A 8/2013
CN 106462106 A 2/2017
(Continued)

OTHER PUBLICATIONS

Combined Chinese Office Action and Search Report dated Oct. 29, 2020 in Chinese Patent Application No. 201910619300.0 (with English translation), 18 pages.
(Continued)

*Primary Examiner* — Edwin A. Leon
(74) *Attorney, Agent, or Firm* — Oblon, McClelland, Maier & Neustadt, L.L.P.

(57) ABSTRACT

A timepiece component including a shaft-like portion including at least one pivot about a pivot axis, wherein at least the constituent material of this shaft-like portion is a ceramic or similar non-magnetic type material, the shaft-like portion includes a plurality of recesses evenly arranged or regularly distributed about the pivot axis, and has its centre of inertia on the pivot axis, and the shaft-like portion includes a collar forming its largest diameter with respect to
(Continued)

the pivot axis, which collar includes a parting line of the shaft-like portion, which parting line is substantially perpendicular to the pivot axis, the recesses pass right through the collar, and at least one recess contains an injection point for the material.

18 Claims, 3 Drawing Sheets

(56) References Cited

FOREIGN PATENT DOCUMENTS

| | | | |
|---|---|---|---|
| CN | 107490950 | A | 12/2017 |
| EP | 3 258 325 | A1 | 12/2017 |
| FR | 1 438 887 | | 5/1966 |
| FR | 2 275 815 | A1 | 1/1976 |
| JP | 51-14057 | A | 2/1976 |
| JP | 54-63852 | U | 5/1979 |
| JP | 2018-28529 | A | 2/2018 |

OTHER PUBLICATIONS

Japanese Office Action dated Oct. 13, 2020 in Japanese Patent Application No. 2019-118231 (with English translation), 4 pages.
Combined Chinese Office Action and Search Report dated Mar. 15, 2021 in Patent Application No. 201910619300.0 (with English translation of Category of Cited Documents), 6 pages.
European Search Report dated Jan. 17, 2019 in European Application 18182666.0, filed on Jul. 10, 2018 (with English Translation of Categories of Cited Documents & Written Opinion).
Japanese Office Action dated Jun. 30, 2020 in Japanese Patent Application No. 2019118231 (with English translation), 14 pages.

* cited by examiner

TIMEPIECE COMPONENT WITH A NON-MAGNETIC SHAFT-LIKE PORTION MADE OF CERAMIC

CROSS-REFERENCE TO RELATED APPLICATION

This application claims priority to European Patent Application No. 18182666.0 filed on Jul. 10, 2018, the entire disclosure of which is hereby incorporated herein by reference.

FIELD OF THE INVENTION

The invention concerns a timepiece component comprising a shaft-like portion including at least one pivot about a pivot axis.

The invention also concerns a timepiece oscillator comprising at least one such component.

The invention also concerns a timepiece movement including at least one such oscillator and/or one at least one such component.

The invention also concerns a timepiece including at least one such movement and/or at least one such oscillator, and/or at least one such component.

The invention also concerns a method for making a timepiece component, more particularly a timepiece wheel set, which component comprises a shaft-like portion, which includes at least one pivot about a pivot axis.

The invention concerns the field of timepiece components and wheel sets, and more particularly the making of wheel sets comprised in oscillators or timepiece movements.

BACKGROUND OF THE INVENTION

The making of small timepiece components, in particular wheel sets, is always a concern for manufacturers, because of machining costs which can be high, and the difficulty in producing certain geometries, in particular when the component concerned has large differences in cross-section, as is the case, for example, of a balance: such a wheel set must pivot perfectly despite a small pivot diameter, and must be sufficiently resistant to shocks, since any skewing results in an unbalance that is detrimental to maintaining a constant oscillation frequency.

Patent Application No. EP3258325A1 in the name of ROLEX discloses a timepiece arbor, particularly a balance staff, including a first functional portion including at least one part of a pivot shank and/or at least one part of a pivot, wherein the first functional portion is made of ceramic and a first external diameter of the first functional portion is less than 0.5 mm, or less than 0.4 mm, or less than 0.2 mm, or less than 0.1 mm.

Patent Application No. FR143887A in the name of TISSOT, discloses a device for attaching one end of a balance spring regulating the timepiece movement to a connection member. This connection member includes fastening recesses, particularly flutes, and can be in one piece with the balance staff with which the balance spring cooperates.

SUMMARY OF THE INVENTION

The invention proposes to offer an alternative to traditional timepiece wheel sets that have steel arbors, and to combine perfect geometry with excellent resistance.

To this end, the invention concerns a timepiece component comprising a shaft-like portion including at least one pivot about a pivot axis.

The invention also concerns a timepiece oscillator comprising at least one such component.

The invention also concerns a timepiece movement including at least one such oscillator and/or one at least one such component.

The invention also concerns a timepiece including at least one such movement and/or at least one such oscillator, and/or at least one such component.

The invention also concerns a method for making a timepiece component, more particularly a timepiece wheel set, which component comprises a shaft-like portion, which includes at least one pivot about a pivot axis.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
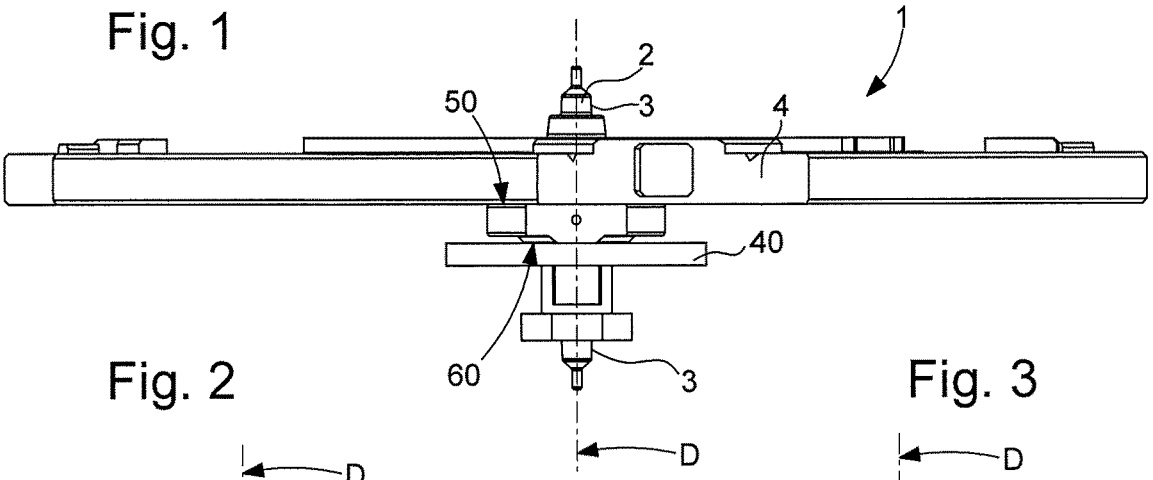
FIG. 1 represents a schematic side view of a timepiece component according to the invention, which here is a wheel set forming a balance and which includes a shaft-like through portion including two pivots at its distal ends on the axis of rotation, which shaft-like portion carries, on a first shoulder, a balance rim which rests laterally on a first flank of a collar which forms the area of largest diameter of the shaft-like portion, which also carries, on a second shoulder and resting on a second flank of the collar opposite to the first, a balance roller carrying an impulse pin.
Figure 2:
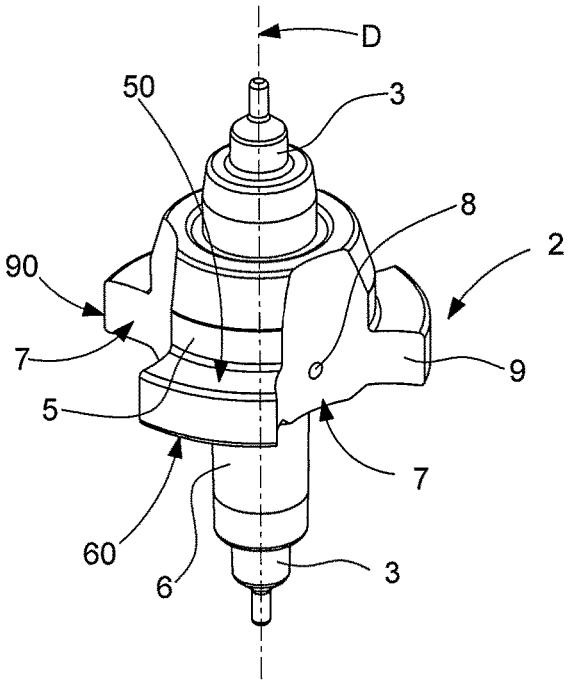
FIG. 2 represents a schematic perspective view showing only the shaft-like portion of this wheel set, which shaft-like portion here includes three recesses at 120° which pass right through the collar, and at the bottom of which injection points are visible.
Figure 3:
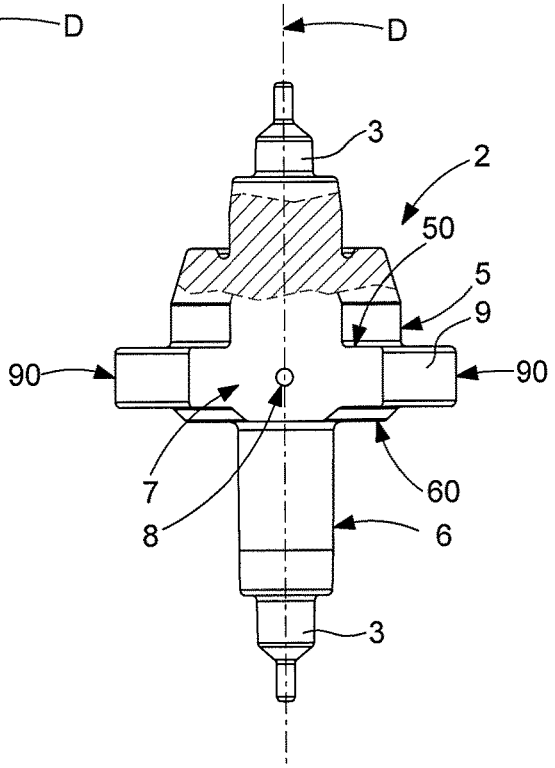
FIG. 3 represents this shaft-like portion in a similar manner to FIG. 1.
Figure 4:
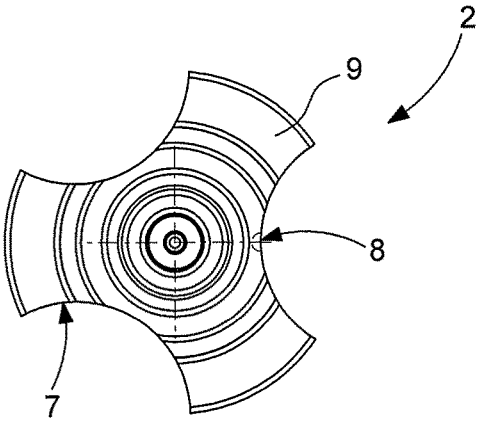
FIG. 4 represents this shaft-like portion in an end view.
Figure 5:
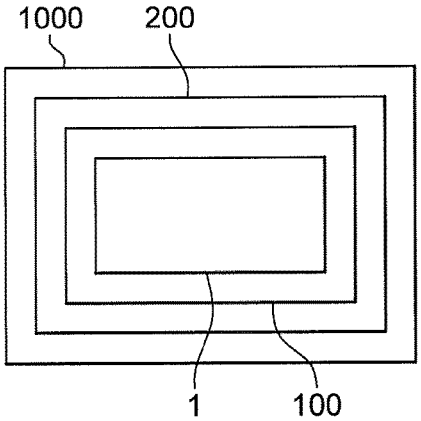
FIG. 5 is a block diagram representing a watch including a timepiece movement, which includes an oscillator that incorporates one such wheel set.
Figure 6:
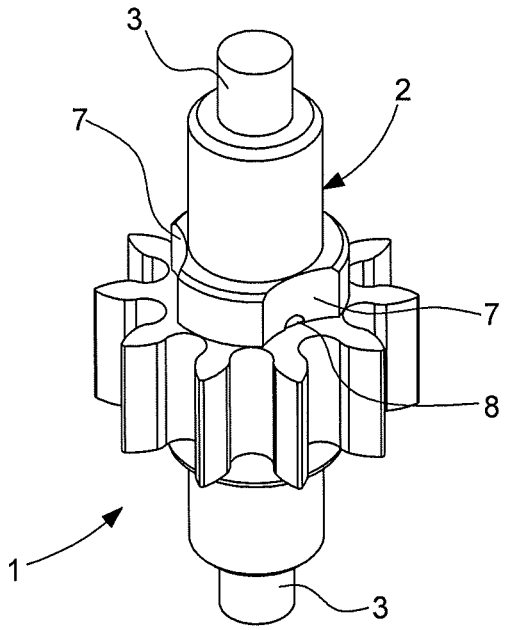
FIG. 6 represents a schematic side view of another timepiece component according to the invention, which here is a wheel set of a gear train, and which includes a shaft-like through portion including two pivots at its distal ends on the axis of rotation, which shaft-like portion carries a pinion.
Figure 7:
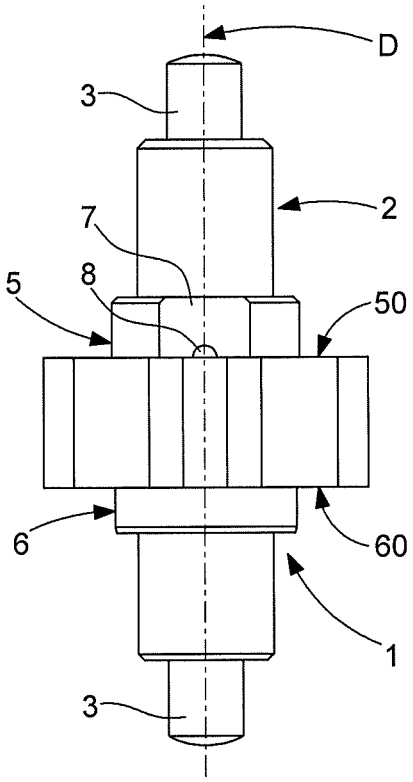
FIG. 7 represents a side view of the wheel set of FIG. 6.
Figure 8:
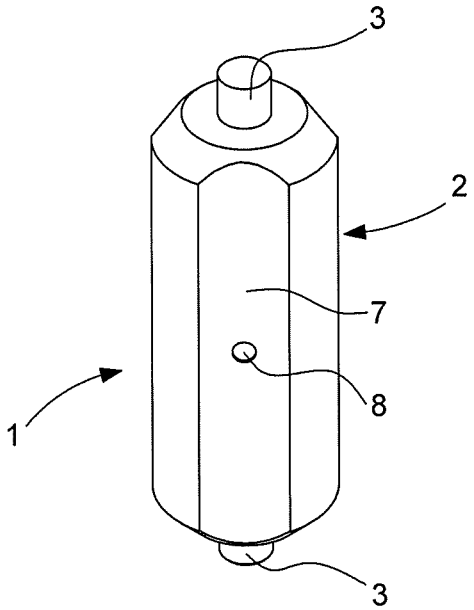
FIG. 8 is a schematic perspective view showing only the shaft-like portion of the wheel set of FIG. 6.
Figure 9:
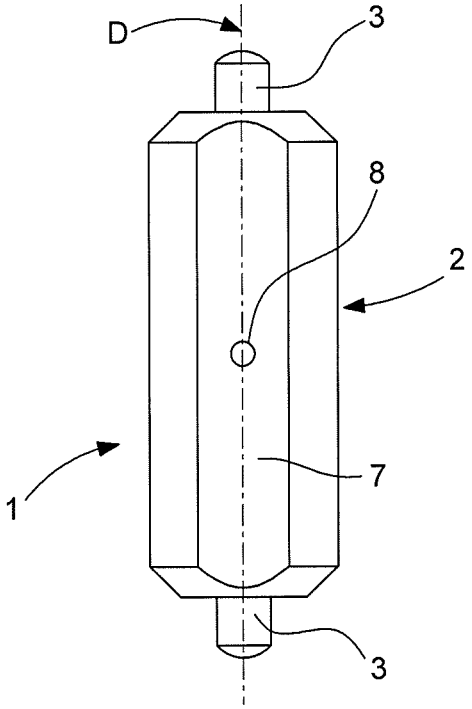
FIG. 9 represents a side view of the shaft-like portion of FIG. 8.
Figure 10:
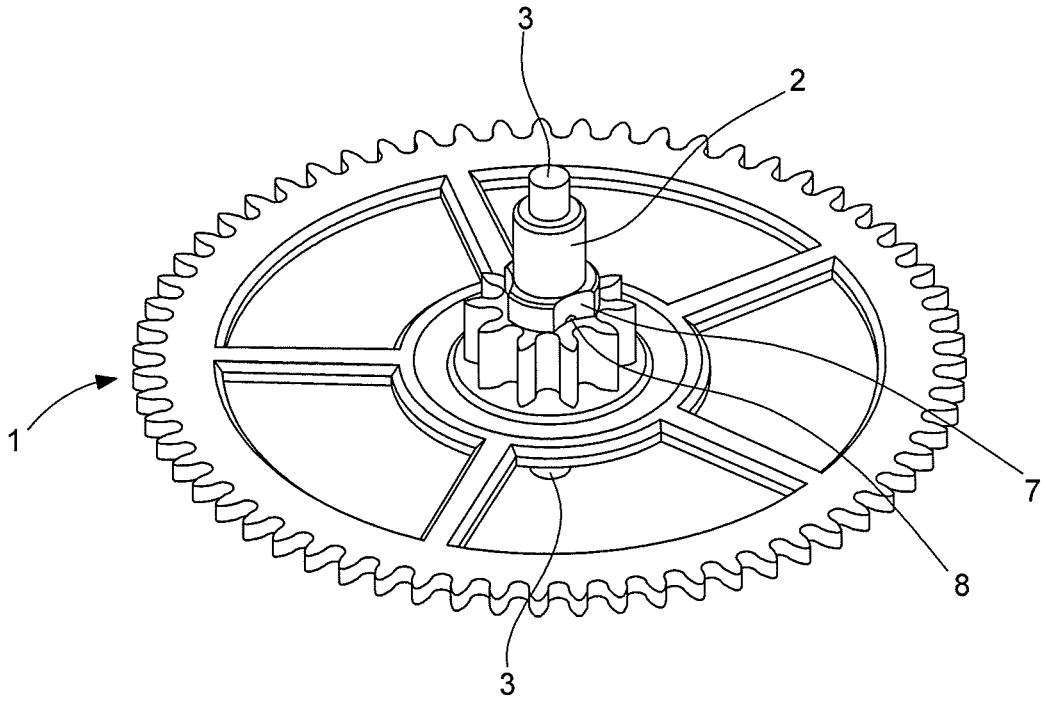
FIG. 10 represents a schematic side view of another timepiece component according to the invention, which here is another wheel set of a gear train, and which includes a shaft-like through portion including two pivots at its distal ends on the axis of rotation, which shaft-like portion carries a pinion and a wheel.
Figure 11:
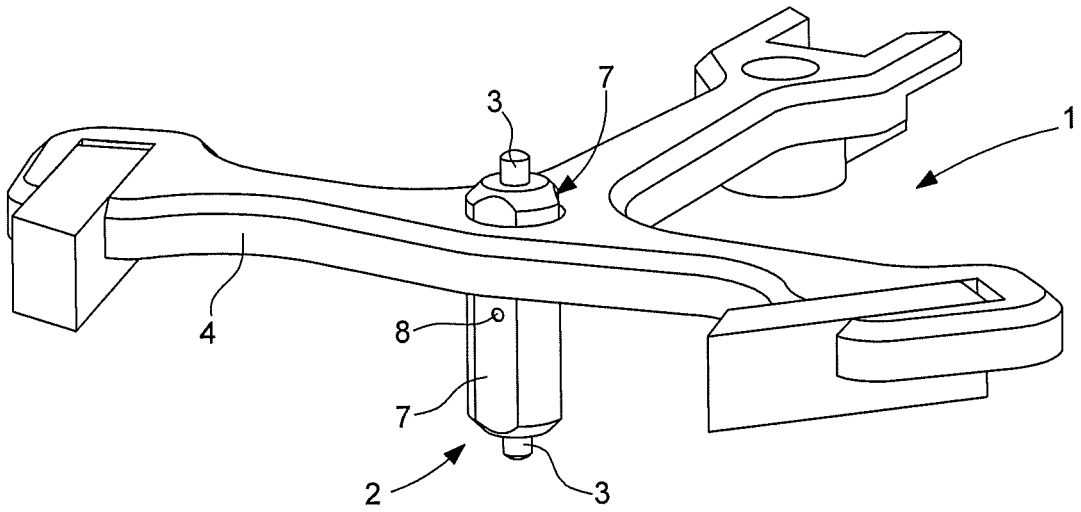
FIG. 11 represents a schematic side view of another timepiece component according to the invention, which here is pallets of an escapement mechanism, and which includes a shaft-like through portion including two pivots at its distal ends on the axis of rotation, which shaft-like portion is the pallet-staff and carries the body of the pallets.

The invention concerns a timepiece component 1, more particularly a timepiece wheel set. This component 1 comprises a shaft-like portion 2, which includes at least one pivot 3 about a pivot axis D.

At least the constituent material of shaft-like portion 2 is a ceramic, or similar.

And this shaft-like portion 2 has a plurality of recesses 7, which are evenly arranged around pivot axis D, and notably which are regularly distributed about pivot axis D, and has its centre of inertia on pivot axis D.

This shaft-like portion 2 includes an area of larger diameter, called collar 9, which constitutes its largest diameter with respect to pivot axis D.

More particularly, this collar 9 includes a parting line 90 of shaft-like portion 2, which parting line 90 is substantially perpendicular to pivot axis D.

More particularly, recesses 7 pass right through collar 9.

According to the invention, in a particular and advantageous embodiment when the constituent material of shaft-like portion 2 is injectable, at least one recess 7 contains an injection point 8 for the material. More particularly, each recess 7 contains an injection point 8 for the material. Advantageously, injection point 8 is located in the area of recess 7 which is closest to pivot axis D. And, in a particular variant, the injection point is located in the direction of axis D in the middle of collar 9.

Placing injection point 8 in a recess 7 is particularly advantageous, since there is therefore no interference whatsoever with any functional revolution shoulder. Further, in the particular case illustrated by the Figures of cylindrical recesses 7, it is extremely easy to adjust injection point 8, and there is absolutely no risk of damaging a functional shoulder.

In another embodiment, at least one injection point is located in another non-functional part of shaft-like portion 2, for example under the largest diameter, or is located in another non-functional part of component 1 made with shaft-like portion 2 and from the same material, notably a ceramic. A 'non-functional part' here means a part of the component that has no surfaces arranged to cooperate with another component of the timepiece mechanism.

In a variant, injection point 8 is placed in the bottom of a groove of revolution.

For manufacture by injection moulding in a two-part mould on either side of parting line 90, the cross-section of the shaft-like portion decreases from parting line 9 towards each distal end which preferably including a pivot 3 and/or a pivot shank. This embodiment makes it possible to obtain pivot shoulders with no injection lines.

The shape of the 'injection point' depends on the mould and on the production facility used. It is generally circular, but this embodiment is not limiting; the injection point can also be a short segment, and its surface area and shape are related to the space available in component 1 in a non-functional area, such as on a pallet shaft, or even a flange or the bottom of a toothing for a pinion, or suchlike. The injection point is advantageously placed in the bottom of a notch or of a recess.

In particular, shaft-like portion 2 includes, for supporting a rim 4 or a roller 40 comprised in component 1, at least one shoulder 5, 6 of revolution about pivot axis D, which is adjacent to at least one support surface 50, 60, which is of revolution about pivot axis D. This rim 4 can be a balance rim, or a toothed roller, or otherwise.

In another embodiment, component 1 is a wheel or a pinion, and includes, on its collar 9, a toothing which can also be made of ceramic, and be produced by injection moulding, which avoids any finish machining or trimming.

More particularly, shaft-like portion 2 includes, on either side of collar 9, first and second shoulders 5, 6, and first and second support surfaces 50, 60.

In a variant, shoulder 5, 6 is cylindrical.

In a variant, second support surface 60 is conical or planar.

FIG. 1 illustrates a component 1, which here is a wheel set forming a balance; and which includes a shaft-like through portion 2 including two pivots 3 at its distal ends on axis of rotation D. Shaft-like portion 2 carries, on a first shoulder 5, a balance rim 4, which rests laterally on a first flank 6 of collar 9. Shaft-like portion 2 also carries, on a second shoulder 50 and resting on a second flank 60 of collar 9 opposite first flank 6, a balance roller 40 carrying an impulse pin.

More particularly, the material is a ceramic. Such a ceramic includes at least a first element chosen from among aluminium oxide, zirconium oxide, silicon oxide, silicon nitride, silicon carbide, titanium carbide, boron carbide, titanium diboride $TiB_2$, diamond, tungsten carbide, vitreous silica, or suchlike. Naturally, this ceramic may include a plurality of components chosen from among aluminium oxide, zirconium oxide, silicon oxide, silicon nitride, silicon carbide, titanium carbide, boron carbide, titanium diboride TiB, diamond, tungsten carbide, vitreous silica, or suchlike. This ceramic generally includes at least one stabilizer, and/or at least one dopant, and/or at least one material for improving mechanical properties such as MgO, CaO, $Y_2O_3$, or suchlike, and/or at least one additive such as carbon, carbon fibres, carbon nanotubes, a coloured pigment, electret, or otherwise, for other lubrication, appearance, magnetic or other properties. In a non-limiting manner, this ceramic is injected into a mould, then sintered to produce the component.

The component illustrated in the Figures, is, for example, advantageously made of zirconium oxide $ZrO_2$ usually called zirconia, with at least one yttrium oxide $Y_2O_3$ dopant.

In particular, the material of the shaft-like portion, notably such a ceramic, is completely non-magnetic.

In an alternative, the material of the shaft-like portion, notably such a ceramic, is filled with magnetized and/or magnetizable particles.

In a particular application, component 1 is a balance and carries, on shaft-like portion 2, at least one rim 4 and one roller 40.

The invention also concerns a timepiece oscillator 100 comprising at least one such component 1.

The invention also concerns a timepiece movement 200 including at least one such oscillator 100, and/or at least one such component 1.

The invention also concerns a timepiece 1000 including at least one such movement 200, and/or at least one such oscillator 100, and/or at least one such component 1. More particularly, this timepiece 1000 is a watch.

The invention also concerns a method for making a timepiece component 1, more particularly a timepiece wheel set, which component 1 comprises a shaft-like portion 2, which includes at least one pivot 3 about a pivot axis D. According to this method, this shaft-like portion 2 is made by injecting a ceramic or similar type material into a mould having at least two parts and arranged to directly produce surfaces of revolution on each pivot 3. More particularly, at least two parts of the mould are aligned on pivot axis D;

more particularly still, these at least two aligned parts extend on either side of a parting line on which is located the area of largest diameter of shaft-like portion 2, which area of largest diameter defines a collar 9. More particularly, the material is injected into the mould at at least one injection point 8 arranged inside at least one recess 7 comprised in collar 9, and which corresponds to a projecting portion of the mould. More particularly, the material is injected at at least one injection point 8, in the area of the recess 7 concerned that is closest to pivot axis D.

After filling the mould, the injection material is then hardened according to the process specific to the material, polymerization, sintering or otherwise. The mould is opened once the injection material has hardened. If necessary, finish machining is carried by grinding and/or diamond polishing, or similar, of the shoulders of revolution and particularly of the pivots and/or pivot shanks comprised in shaft-like portion 2. When component 1 is not limited to shaft-like portion 2 and includes at least one added element, such as a rim 4 and/or a roller 40, and/or impulse pin or suchlike, each such element is placed on the shaft-like portion and immobilized by bonding or similar. More particularly, but not exclusively, this immobilization is irreversible.

The invention thus makes it possible to make a timepiece component, and in particular a timepiece wheel set, with a precise shape and surfaces of revolution by injecting material into a mould having at least two parts. This material may, in particularly, be a non-magnetic ceramic. The production method makes possible a saving of material since the component is made with substantially the finished dimensions, and a significant saving in machining. This injection method also ensures good immediate poising of the shaft-like portion. Finishing operations are reduced to a minimum, and, depending on the function of component 1, may even be superfluous.

The invention claimed is:

1. A timepiece component comprising:

a shaft-like portion including at least one pivot about a pivot axis, wherein said shaft-like portion comprises a collar forming a largest diameter of said shaft-like portion with respect to said pivot axis, the collar including a parting line of said shaft-like portion, the parting line being substantially perpendicular to said pivot axis, wherein a constituent material of said shaft-like portion is a ceramic, wherein said shaft-like portion includes a plurality of recesses evenly arranged around said pivot axis, the plurality of recesses passing through said collar, and the plurality of recesses having a center of inertia on said pivot axis, and wherein at least one recess of the plurality of recesses contains an injection point for said material.

2. The component according to claim 1, wherein said recesses pass right through said collar.

3. The component according to claim 1, wherein said injection point is located in the area of said recess which is closest to said pivot axis.

4. The component according to claim 1, wherein said injection point is in a non-functional part of said shaft-like portion, or in another non-functional part of said component made with said shaft-like portion and from the same material.

5. The component according to claim 1, wherein said shaft-like portion comprises, for supporting a rim or a roller comprised in said component, at least one shoulder of revolution about said pivot axis adjacent to at least one support surface of revolution about said pivot axis.

6. The component according to claim 1, wherein said shaft-like portion comprises, for supporting a rim or a roller comprised in said component, first and second shoulders of revolution about said pivot axis adjacent to first and second support surfaces of revolution about said pivot axis, the first and second shoulders being on either side of said collar.

7. The component according to claim 5, wherein said shoulder is cylindrical.

8. The component according to claim 6, wherein said second support surface is conical or planar.

9. The component according to claim 1, wherein said material is a ceramic containing at least a first element chosen from among aluminium oxide, zirconium oxide, silicon oxide, silicon nitride, silicon carbide, carbide, boron carbide, titanium diboride TiB2, diamond, tungsten carbide and vitreous silica.

10. The component according to claim 9, wherein said ceramic contains at least one additive chosen from among MgO, CaO, Y2O3, carbon, carbon fibres, carbon nanotubes, coloured pigments and electrets.

11. The component according to claim 1, wherein said material is a ceramic made of zirconium oxide ZrO2 with an yttrium oxide Y2O3 dopant.

12. The component according to claim 1, wherein said ceramic is completely non-magnetic.

13. The component according to claim 1, wherein said ceramic is filled with at least one of magnetized or magnetizable particles.

14. The component according to claim 1, wherein said component is a balance, and carries, on said shaft-like portion, at least one rim and one roller.

15. A timepiece oscillator comprising at least one component according to claim 1.

16. The timepiece movement comprising at least one oscillator according to claim 15.

17. The timepiece comprising at least one movement according to claim 16.

18. The timepiece according to claim 17, wherein said timepiece is a watch.

* * * * *